US005105970A

United States Patent [19]

Malone et al.

[11] Patent Number: 5,105,970

[45] Date of Patent: Apr. 21, 1992

[54] FREIGHT CONTAINER INSULATING SYSTEM AND METHOD

[75] Inventors: Thomas G. Malone, La Jolla; William E. Mensch, San Diego, both of Calif.

[73] Assignee: Cargo Technology Corporation, San Diego, Calif.

[21] Appl. No.: 494,684

[22] Filed: Mar. 16, 1990

[51] Int. Cl.[5] ..... E04B 1/74

[52] U.S. Cl. ..... 220/445; 220/452; 220/453; 220/1.5; 220/470; 206/523

[58] Field of Search ..... 220/437, 400, 445, 449, 220/451, 452, 453, 1.5, 3.1, 470, 901, 469; 217/3 R, 3 VC; 150/901, 154; 206/813, 523; 428/71

[56] References Cited

U.S. PATENT DOCUMENTS

| | | | |
|---|---|---|---|
| 2,066,337 | 1/1937 | Cunningham | 217/12 |
| 2,591,168 | 4/1952 | Latham, Jr. et al. | 220/3.1 X |
| 3,339,778 | 9/1967 | Herrenschmidt | 220/452 X |
| 4,021,982 | 5/1977 | Kotcharian | 220/453 X |
| 4,339,039 | 7/1982 | Mykleby | 220/445 X |
| 4,373,643 | 2/1983 | Pyzytarski | 220/450 |
| 4,497,859 | 2/1985 | Baumann | 206/523 X |
| 4,709,817 | 12/1987 | Keady et al. | 206/523 |
| 4,730,748 | 3/1988 | Bane | 220/452 X |

*Primary Examiner*—Steven M. Pollard
*Attorney, Agent, or Firm*—Knobbe, Martens, Olson & Bear

[57] ABSTRACT

A freight container insulating system for retrofitting, on a temporary or semi-permanent basis, a conventional uninsulated freight container is provided, and consists of a plurality of individual insulation support members selectively attachable to the interior walls of a freight container and from which one or more insulating blankets are attached to and suspend to cover and surround the freight cargo. When fashioned out of a cross-linked polyethylene foam, the support members themselves provide heat insulation capability along with spacing the insulating blanket a distance from the interior container surface, creating an insulating layer of air. Additional insulating enhancement is provided by utilizing as the insulating blanket, two layers of a closed-cell polyethylene material laminated together, with a layer of reflective foil attached to the blanket surface that faces the container wall. The insulation envelope is completed by an insulated floor covering sheet, which may also consist of a closed-cell polyethylene insulating material.

26 Claims, 1 Drawing Sheet

FREIGHT CONTAINER INSULATING SYSTEM AND METHOD

FIELD OF THE INVENTION

The present invention relates to insulated air cargo containers and more particularly to an insulation system that permits the rapid conversion of conventional freight containers, such as those presently in use by airlines to transport cargo from one destination to another, to a cargo container suitable for transporting heat-sensitive cargo.

BACKGROUND OF THE INVENTION

When transporting perishable goods, a conventional air cargo container has inadequate insulation to maintain a controlled temperature environment, such that unacceptably high loss levels of perishable goods are encountered during transport. There are presently available refrigerated air-freight containers having a self-contained refrigeration unit, which provide effective environmental/temperature control. However, such containers are bulky and expensive, can only be used effectively for environmentally-sensitive freight, and are generally only cost-efficient for those businesses transporting extremely high cost, perishable goods.

Aside from the refrigerated containers that are presently available, there are also pre-fabricated, non-refrigerated, insulated containers, such as that disclosed in U.S. Pat. No. 4,373,643 issued to Przytarski. The insulation system is specially fabricated and becomes an integral part of the container. The interior rigid walls of the Przytarski container are lined with multiple layers of insulation including an inner layer of moisture-absorbing material, which acts as an humidity regulator, and a single layer of heat insulating material. Such pre-fabricated containers can be effective at maintaining controlled environments. However, like their refrigerated counterparts, these custom-designed units are expensive and are essentially dedicated to such service. They are cost-effective only when a business is solely engaged in transporting perishable goods and other specially-handled cargo.

For many transport businesses, efficient operation depends on the flexibility of handling various types of freight on a daily basis, including both freight that is environmentally sensitive and shipments that are not. Having the capability to convert a conventional container into an insulated container is advantageous to many transport businesses. Present means of such conversion are limited in their use as well as being expensive and inconvenient to install. Some conversion systems require that modifications be made to the container before the insulation system can be installed; e.g., boring a series of small holes in the sides of the container to accommodate a great many retaining hooks, from which the insulation system suspends. In addition, some systems utilize zipper fasteners to join adjacent components, thus making the system more expensive and requiring a more accurate installation of the components, translating into higher labor and loading costs. Moreover, many present systems can be installed in only certain standard containers or those of a specific shape, and do not permit the flexibility of use over a wider range of available transport containers. Another type of container-converting insulation system is taught by Baumann in U.S. Pat. No. 4,497,859. This system provides an insulating insert consisting of panels of alternating, closely-packed insulating material that are joined along their perimeters to conform to the interior of the transport container. A fluid-tight trough and bottom plate are also provided, making the system cumbersome and more difficult to install.

In light of present insulation systems, there is need for a cost-efficient and simplified insulation system that is effective at maintaining a controlled environment. Such a system must be capable of converting conventional containers into insulated containers at a minimal expenditure in time and materials, but without sacrificing the effectiveness of both the container and the insulation system. Additionally, since weight is critical for air freight, the insulation must provide these benefits without adding significant weight to the container.

It would therefore be a novel improvement to provide a freight container insulation system capable of retrofitting a conventional uninsulated freight container that includes an adhesive support means for attaching the insulation system to the interior walls of the container, a multi-layer insulated blanket affixed to the adhesive support means, covering the interior container walls to which the adhesive support means is attached, a second multi-layer insulated blanket that is draped across an access opening to the container, and an insulated sheet for placing across the bottom of the container, whereby a controlled environment is created within the confines of the container.

It would be another novel improvement to provide a freight container insulation system wherein the adhesive support means is a plurality of linear strips, constructed of an insulating material, that may be selectively sized and then affixed to the interior walls of the container in a random orthogonal fashion, and wherein the insulated blanket comprises at least one layer of a closed-cell polyethylene and at least one layer of a reflective foil laminate, which may be formed into a roll or be prefabricated and sectioned into discrete individual panels that are sized to cover a corresponding interior container wall, with the insulated sheet for the container bottom constructed of closed-cell polyethylene.

It would also be a novel improvement to provide a freight container insulation system wherein the insulation system defines a layer of air between the container walls and the installed insulation blanket, thereby incorporating the insulative qualities of air as part of the insulation system.

SUMMARY OF THE INVENTION

The instant invention may be used to convert a conventional freight transport container into an insulated container, which is then capable of maintaining a controlled temperature environment for perishable goods and other specially-handled cargo. By permitting transport businesses to convert a wide variety of containers into insulated containers, the instant invention permits a transport business to maintain flexibility while offering the added advantage of reducing its investment in inventory and fixed costs. Additionally, the freight container insulation system of the present invention provides a means of converting a conventional freight container into an insulated container in a matter of minutes, thus saving assembly time and labor costs over current methods of conversion.

The instant invention comprises three lightweight components, designed to provide cumulative insulating effects. The first component of the preferred embodiment is a polyethylene foam strip, referred to as a "stick," which is used to attach the insulation system to the inner container walls and separate a second system component from the inner surface of the container walls, creating an insulating dead air space. This second component, discussed below, hangs from the strips and is attached thereto by adhesive means.

The foam strip is preferably laminated on both sides with a strong paper-backed adhesive to permit the user to quickly affix the strip to the container walls simply by peeling the paper away from the polyethylene foam core and pressing the same against an inner container wall. The foam strips may easily by cut to desired lengths, and then may be arranged in a random orthogonal fashion along the interior of the container, or if desired, in a more uniform grid fashion. It is intended that the strips may be affixed to the interior top and side walls of the container in any other obvious arrangement desired to facilitate ease of installation while creating a "baffled" surface over the container wall, which later, in conjunction with the insulated sheetform material, creates the insulating air spaces. When the strips are installed, the paper covering the outer layer of adhesive may be peeled back from each of the foam strips to reveal an adhesive support means upon which a layer of insulation may adhere and suspend.

A second component of the preferred embodiment is a multi-ply laminated sheet of polyethylene insulation, referred to as an "insulation blanket". Preferably constructed of two layers, including a closed-cell polyethylene and a layer of reflective foil laminate, individual panels of the insulation blanket are draped against corresponding interior container walls. Attaching directly to the adhesive sticks, the insulation blanket is arranged with the foil side directed outwardly from the interior of the container and functioning as a heat reflector. To permit the door to the container to remain open while the container is being loaded with cargo, a front panel of insulated blanket material is kept rolled up and clear of the opening until loading is completed. When the container is fully loaded, including the refrigerant where required, the front panel of insulation is unrolled and drawn across the container opening. The perimeter about the front panel is then preferably sealed with a packaging tape. With the cargo effectively insulated, the container door may be closed and secured, and the container transported to its final destination.

A third component of the preferred embodiment is a separate, single sheet of closed-cell polyethylene that is used to cover the bottom of the container prior to loading. The polyethylene sheet provides effective insulative capabilities even while compressed under the weight of the cargo stored within the container. It is further intended that the polyethylene sheet extend up and overlap a portion of each individual panel of the insulated two-layer blanket that extends down along the interior sides of the cargo container, forming an effective interior "insulation envelope" for the cargo.

It is well known that air has exceptional insulative qualities, and that the creation of "dead airspace" is desirable to enhance an insulation system. In the instant invention, the resulting air layer that is created along the interior container walls by using the foam strips to attach the insulated envelope or blanket to the interior walls, provides a thermally efficient layer of insulation that, together with the insulation envelope, significantly reduces convective heat transfer. It is important to note as well that the material chosen for the foam strips is designed to provide some insulative qualities, preventing the insulation support structure from itself serving as a source of conductive heat transfer from the ambient surroundings. Further amounts of conductive heat transfer are reduced by the double layers of closed-cell polyethylene in the insulated blanket. The foil laminate covering the exterior face of the insulated blanket acts to reflect radiant heat directed toward the container during transport, redirecting this radiant heat back towards the outside container. Consequently the system as a whole is effective in significantly reducing all three types of heat transfer—convective, conductive, and radiant.

The advantages of the instant invention are that the freight container insulation system is light-weight, so that shipping costs reflect the weight of the cargo and not the weight of the insulation. In addition, the components of the system are strong enough to be reusable, while maintaining the insulative characteristics necessary to provide a controlled environment over relatively long periods of time in transit. When a freight container has reached its intended destination and the cargo is unloaded, the insulation system may be rapidly removed from the cargo container and reserved for later use. Once the bottom sheet of polyethylene is removed, the individual panels of insulation blanket may be peeled off of the adhesive sticks. The adhesive sticks are then removed from the container walls and the system may be stored until it is desired to insulate another cargo container at a later date.

Other advantages also may be appreciated for the instant invention. Although durable, the insulation system utilizes generally available components, and these components are generally at a cost level whereby a user may either retain or dispose of the used system, and still remain cost-effective. The system may also be made available in the form of readily-installed kits, designed for installation in most freight containers. Finally, because the system is capable of converting virtually all available cargo containers presently being used in the air transport industry, the use of the system may improve the flexibility of the cargo container inventory owned or leased by a transport business in a cost-effective manner.

BRIEF DESCRIPTION OF THE DRAWINGS

These and other advantages of the present invention may best be understood through reference to the drawings, in which.

DETAILED DESCRIPTION OF THE PREFERRED EMBODIMENT

Reference is now made to the figures wherein like parts are designated with like numerals throughout.

Figure 1:
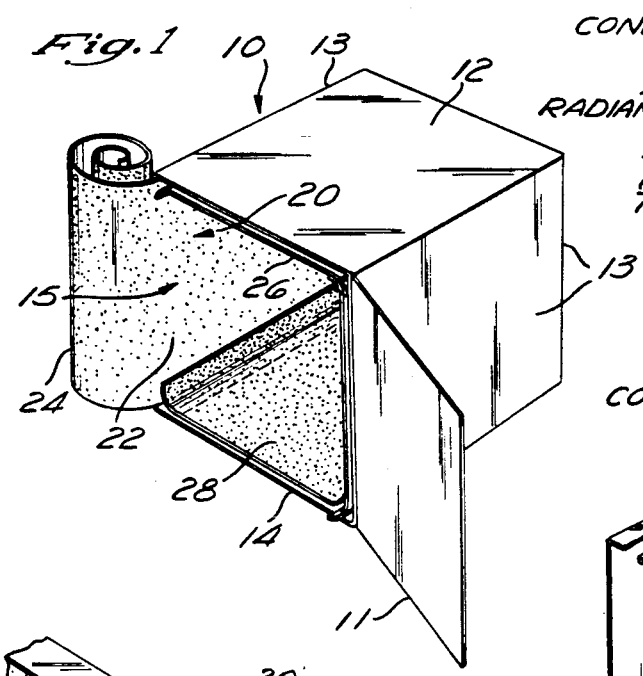
FIG. 1 is a right-front perspective view of the preferred embodiment showing the polyethylene sheet on the bottom of a converted cargo container and the front panel of insulation blanket rolled up to the side of the container opening.
Figure 2A:
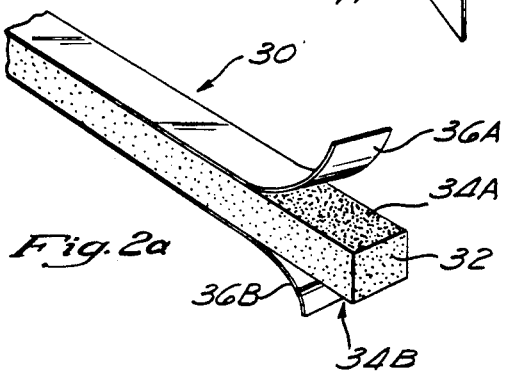
FIG. 2*a* is an enlarged partial perspective view of the laminated polyethylene foam strip.
Figure 2B:
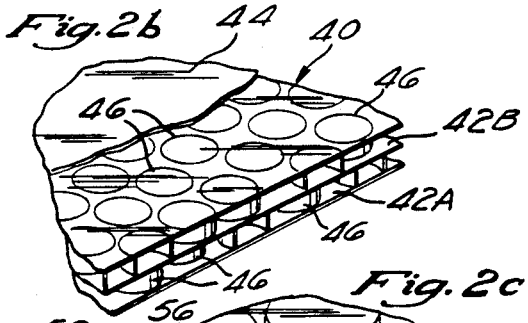
FIG. 2*b* is an enlarged partial perspective view of the closed-cell polyethylene insulated blanket.
Figure 2C:
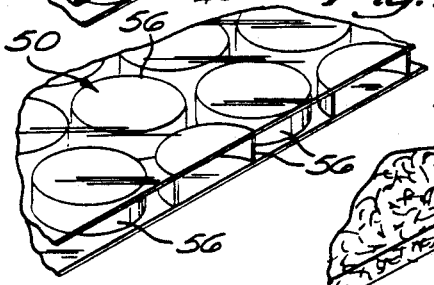
FIG. 2*c* is an enlarged partial perspective view of the closed-cell polyethylene sheet.
Figure 2D:
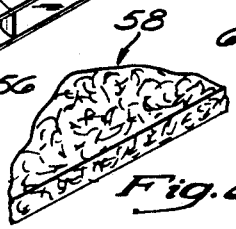

The invention is an insulating system for use in cargo containers such as those used in the transport of freight by airlines. Cargo containers are generally available in numerous shapes and sizes to accommodate various volumes and types of freight and their installation in the cargo areas of airplanes. Inventively, the cargo insulation system of the present invention is capable of effectively insulating a cargo container having virtually any shape and/or dimensions. As an example, FIG. 1 shows a typical cargo container 10 of generally cubic shape with a door 11, a top wall 12, three side walls 13, a bottom wall 14 and a freight access opening 15 when the door 11 is open to permit the loading and the unloading of cargo. When properly installed, the present invention acts as an insulating envelope, forming a heat "barrier" between the interior walls of the cargo container and the freight.

Referring again to FIG. 1, the insulation system 20 is shown installed within the interior of the cargo container 10 with a portion of the insulation system rolled back to expose the interior of the container. The preferred embodiment of the insulation system 20 consists of a plurality of insulating wall panels such as panel 22, shown covering side wall 13 in FIG. 1. Panel 22 is preferably identical in construction, although not necessarily in shape and size, to the insulating panels sized to cover the two remaining side walls 13, as well as the top container wall 12. In addition, the invention comprises a door panel 24 that is intended to drape across the freight access opening 15 when the cargo contents are fully loaded for shipment. The insulation system further consists of a top panel 26 covering the interior face of the top wall 12 and a floor panel 28 covering the bottom wall 14 of the container 10. The floor panel 28 is discussed in further detail in reference to FIG. *2c*.

During loading and unloading, the door panel 24 may be rolled back as shown in FIG. 1 to facilitate access to the freight. After the contents are fully loaded, the door panel 24 may then be unrolled and sealed in place to cover the access opening 15, as will be discussed in further detail below. With the insulating envelope completed, the cargo container is prepared for transporting perishable and other environmentally sensitive goods.

The insulating system 20 consists of three basic components as may be seen by referring to FIGS. *2a–2c*. The first component is a polyethylene foam strip 30, which is shown in FIG. *2a*. Known as a "stick," the foam strip 30 consists of a cross-linked polyethylene foam core 32, such as Polyolefin, which is readily available and may be obtained from Arlon of Santa Ana, Calif. The foam strip 30 is coated on a pair of opposite surfaces 34A and B with a releasible-adhesive material. In the preferred embodiment, the adhesive material is an acrylic-based Dow Chemical adhesive, however, it is contemplated that the adhesive material may be any adhesive that permits effective adhesion between the foam strip 30 and both the interior surface of the container and the insulating blanket 40 (neither are shown in FIG. *2a*). A first adhesive-coated surface 34A may be exposed by pulling away a protective layer of paper 36A from the adhesive and attaching the first adhesive-coated surface 34A to the cargo container (not shown in FIG. *2a*) in a manner described more fully below.

A second component of the present invention is an insulative blanket 40, which comprises, in a preferred embodiment, a sheet-form insulative layer, shown in FIG. *2b* as a three-ply insulative sheet. FIG. *2b* shows a portion of the insulative blanket 40 illustrating in detail a pair of layers of polyethylene material 42A and B joined together and laminated on one side by a layer of reflective foil 44, (or, instead, a metalized plastic film layer). The polyethylene layers 42A and B, which may be made of hot formed polyethylene or other similar material, such as is supplied by Sealed Air Corporation, Los Angeles, Calif., or by other manufacturers in the packaging materials industry, are constructed with a plurality of closed cells 46, which act to increase the insulative capabilities of the insulative blanket 40 by trapping dead air within. In the preferred embodiment, the insulative blanket 40 may be sectioned into individual panels that correspond in dimensions to the interior walls of the cargo container 10, as discussed above in reference to FIG. 1. Alternatively, it is contemplated that the insulative blanket may consist of a continuous sheet, either planar or as an open bag sized to fit the interior walls of a cargo container. Regardless of the form, sheet, bag, or individual panels, when placed in the cargo container 10, the insulative blanket 40 is affixed to a second, adhesive-coated surface 34B of the foam strips 30 (See FIG. *2a*).

A final component of the preferred embodiment is an insulative floor covering sheet 50, a portion of which is shown in FIG. *2c*. The floor covering sheet 50 is used to form the floor panel 28 discussed above in reference to FIG. 1. Similar in design to the insulative blanket 40, the floor covering sheet 50 is likewise preferably made of hot-formed polyethylene. However, instead of the two layers 42A and B, and a thickness of 5/16 inches, the floor covering sheet 50 is preferably a single layer of ½ inches in thickness, and no foil layer is required. Additionally, instead of bubble diameters of 5/16 inches, the floor covering sheet 50 utilizes a plurality of enlarged cells 56, having bubble diameters of 1 inch, with plastic layer thickness of 13 mils (the two layer laminate uses plastic of 8 mils). These design modifications permit the floor covering sheet 50 to withstand the weight of the cargo as well as the loading process itself, while remaining an effective insulator. The floor covering sheet 50 having such fortified features may be obtained from the same supplier as are the two-layer, insulative blanket 40.

Alternatively, the floor panel 28 may be constructed of a sheet of closed-cell polyethylene foam 58, a portion of which is shown in FIG. *2d*. The polyethylene foam sheet 58 is constructed of hot formed polyethylene such as is provided by Seal Air Corporation. The manner by which the foam strip 30, the insulative blanket 40, and the insulative floor covering sheet 50 or the polyethylene foam sheet 58 are combined to form the present innovative insulation system is more clearly understood by referring to FIGS. 3 and 4.

Figure 3:
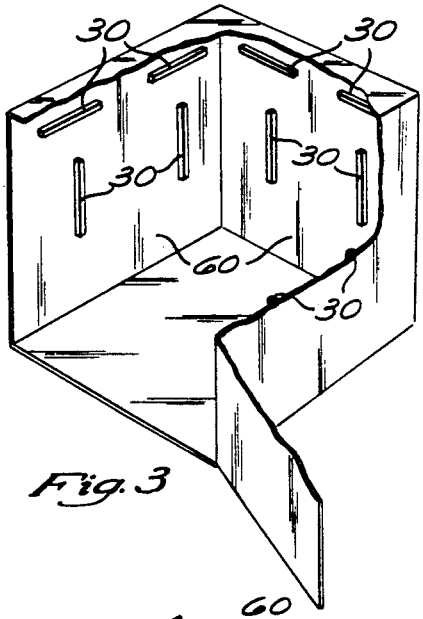
FIG. 3 is a perspective view, with portions broken away, showing the laminated strips as affixed to the interior vertical walls of a cargo container during installation of the insulating system of the present invention.

When it is desired to install the insulation system, a plurality of foam strips 30 may be affixed to the cargo container 10, as shown in FIG. 3. A first adhesive-coated surface 34A of the foam strip 30 attaches directly to an interior surface of a container wall, while a second adhesive-coated surface 34B is available to attach to and support the insulative blanket 40, as is described above. While the foam strips 30 may be arranged in any desired pattern on the interior walls of the container 10, FIG. 3 shows the strips arranged in a spaced orthogonal pattern. It is contemplated under the present invention that the strips may be arranged in a more random format, or in a precise, uniform grid pattern, as desired.

Figure 4:
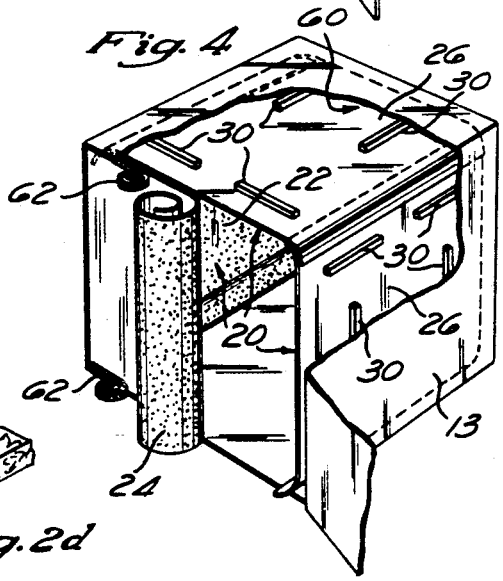
FIG. 4 is a perspective view similar to FIG. 3, with portions in phantom and portions broken away, showing the individual panels of the insulated blanket affixed to the laminated strips, with the front panel of insulation shown partially installed.

Once the foam strips 30 are positioned as desired and attached to the interior walls, the protective layer of paper 36B may then be peeled away to expose the second adhesive-coated surface 34B to which the foil laminate 44 on the individual panels of the insulation blanket 40 may preferably be adhered. FIG. 4 shows the top and side panels of insulation blanket 40 in place. There it may be seen that the outer closed-cell, polyethylene layer 42A of the insulation blanket 40 is shown exposed toward the interior of the cargo container 10 while the foil laminate 44 is shown facing the opposite direction, toward the container walls. The increase in insulation effectiveness obtained by such an arrangement will be discussed below in association with FIG. 5.

The insulative blanket 40 is preferably installed one panel at a time. For instance, insulative panel 26 is attached to the top wall 12 of the cargo container 10, while insulative panels 22 are attached to the side walls 13, as shown in FIG. 4. The resulting insulative air layer 60 is defined by the space formed between the insulation blanket 40 and the container walls.

In the preferred embodiment, the insulative panels 22 and 26 have dimensions greater than that of the corresponding container wall so that individual insulative panels will overlap. With overlapping panels in place, a continuous envelope of insulation is provided around the load of freight when the insulation system is completely installed. To complete the installation of the insulation system 20, the insulative door panel 24 is drawn entirely across the freight access opening 15 and sealed along its perimeter before closing the container door in preparation for transport. In the preferred embodiment, the insulative door panel 24 is also sized with dimensions greater than the container door 11 so that overlapping ends may be tucked inside immediately adjacent the adjacent insulative panels 22 and 26. Referring to FIG. 4, the door panel 24 of the insulation blanket 40 is shown partially unrolled as it is drawn across the freight access opening. The joint created between the door panel 24 and the adjacent side panels 22 and top panel 26 is then sealed by any convenient means, preferably by ordinary packing tape 62 such as Gator Tape.

It should be noted that other embodiments of the present invention are applicable for other styles of cargo containers. However, the general concept remains the same—that of enveloping the cargo with an insulative blanket that is preferably sectioned into individual panels that correspond to the interior container walls. In one preferred embodiment, a cargo transport company can select an insulation system of the present invention tailored to meet the specific shape and dimensions of its various transport cargo containers.

Figure 5:
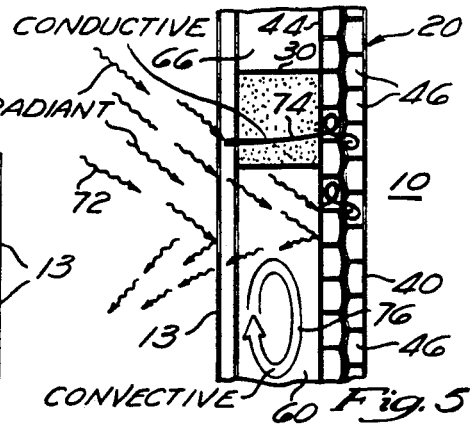
FIG. 5 is a representative cross-section of the present invention shown attached to a vertical container wall schematically illustrating the thermal properties of the present invention.

An appreciation of the thermal properties of the insulation system may be obtained by referring to FIG. 5, which illustrates a representative, cross-sectional view of the installed insulation system. The foam strip 30 is affixed to the container wall 13 in a horizontal position, thereby separating the insulative blanket 40 from the container wall, and creating an insulative air layer 60. The insulative wall panel 22 of the insulative blanket 40 is shown with its two adjoining layers of closed-cell polyethylene 42A and B coated with a foil laminate 44.

Schematically, FIG. 5 illustrates how the insulation system 20 of the present invention significantly reduces the heat transfer from the ambient surrounding. First, radiant heat, depicted by arrows 72, is partially repelled by the container wall itself. The radiant heat that penetrates the container wall is then further repelled by the foil laminate 44 which functions similar to a mirror in reflecting incoming rays. Conductive heat transfer, shown by arrow 74, is reduced initially by the insulative properties of the polyethylene foam sticks 30. A majority of the balance of conductive heat that penetrates the foam strips 30 is then trapped within the closed-cells 46 of the insulative blanket 40, further reducing the transfer into the interior of the container 10. Finally, the insulative air layer 60 acts to trap significant amounts of convective heat within, shown by arrow 76. In cooperation with each other, the components of the insulation system 20 significantly reduce the heat transferred to the interior of the cargo container from the ambient environment, thereby permitting a selected environment to be maintained within the container for a period of time during transport much longer than would otherwise be possible.

The invention may be embodied in other specific forms without departing from its spirit or essential characteristics. The described embodiment is to be considered in all respects only as illustrative and not restrictive and the scope of the invention is, therefore, indicated by the appended claims rather than by the foregoing description. All changes that come within the meaning and range of equivalency of the claims are to be embraced within their scope.

What is claimed is:

1. A freight container insulation system capable of retrofitting a conventional uninsulated freight container, said insulation system comprising:

a plurality of insulative strips, each having opposing sides having an adhesive deposited thereon for attaching the insulation system to the freight container, the strips being readily removable from the freight container;

a first multi-layer insulated blanket affixed to the insulative strips so that the container walls covered with said insulative strips are correspondingly veiled with said first insulated blanket to establish an air space between the blanket and container;

a coating having at least one reflective surface disposed on said first blanket with the reflective surface facing the air gap;

a second multi-layer insulated blanket draped across an access opening to the container; and an insulated sheet placed across the bottom of said container.

2. The freight container insulation system of claim 1, wherein the adhesive support means is a plurality of linear strips, said strips affixed to at least four interior walls of the container, said strips having opposite sides coated with an adhesive, which is in turn covered with non-stick paper to facilitate handling.

3. The freight container insulation system of claim 1 or claim 2 wherein the adhesive support means is constructed of insulative material.

4. The freight container insulation system of claim 3 wherein the insulative material is foam.

5. The freight container insulation system of claim 2 wherein the strips are arranged on the container walls in a grid fashion.

6. The freight container insulation system of claim 2 wherein the strips are arranged in a spaced orthogonal fashion.

7. The freight container insulation system of claim 2 wherein the strips are arranged in any random fashion desired.

8. The freight container insulation system of claim 1 wherein the first and second insulated blanket comprises at least one layer of closed-cell polyethylene and at least one layer of reflective foil laminate.

9. The freight container insulation system of claim 8 wherein the first and second insulated blanket are installed with the reflective foil laminate facing toward the exterior of the container.

10. The freight container insulation system of claim 1 wherein the first insulated blanket further comprises discrete individual panels, said individual panels shaped to cover a corresponding interior wall of the container.

11. The freight container insulation system of claim 1 wherein the insulated sheet is constructed of closed-cell polyethylene foam.

12. The freight container insulation system of claim 1 wherein said insulation system defines a layer of air between the container walls and the insulation blanket.

13. An insulation system for converting an uninsulated, conventional, freight container, said insulation system comprising:

a plurality of adhesive-backed and faced strips arranged in a spaced random pattern on at least four interior walls of the freight container, said strips exhibiting insulative qualities;

a first insulated blanket affixed to the strips and covering the top and vertical walls of the interior of the container, said first blanket establishing, in combination with the container, an air space between the blanket and container;

a second insulated blanket draped across an access opening to the container, said first and second insulated blankets laminated with reflective foil directed outwardly, and an insulated sheet placed on the bottom of the container, said insulated sheet overlapping a portion of the insulated blanket.

14. The insulation system of claim 13 wherein the strips are constructed of polyethylene foam.

15. The insulation system of claim 13 wherein the first and second insulated blankets are constructed of two layers of closed-cell polyethylene.

16. The insulation system of claim 13 wherein the first insulated blanket further comprises discrete individual panels, said individual panels shaped to cover corresponding interior walls of the uninsulated container.

17. The insulation system of claim 13 wherein the insulated sheet is constructed of closed-cell polyethylene foam.

18. A method of converting an uninsulated freight cargo container into an insulated container capable of providing a controlled environment, said method comprising:

affixing readily removable insulative strips having adhesive deposited on outer and inner faces thereof onto the interior walls of the uninsulated container with said outer faces contacting said interior walls;

affixing a first, multi-layer, composite insulated blanket to the inner faces of said strips so that at least four interior walls of the container are covered with said insulated blanket, said blanket having a reflective surface directed outwardly;

establishing an air gap between the first blanket and the walls of the container;

draping a second, multi-layer, composite insulated blanket across an access opening of the uninsulated container;

sealing the second insulated blanket to the first insulated blanket, and placing an insulated sheet across the bottom of the uninsulated container.

19. The method of converting an uninsulated freight cargo container of claim 18 wherein the adhesive support means is a plurality of paper-backed, adhesive-coated strips.

20. The method of converting an uninsulated freight cargo container of claim 19 wherein the step of affixing an adhesive support means further comprises the steps of removing the paper backing from a first adhesive coating on the strips, arranging said strips in a desire pattern, and pressing the first adhesive coating to the container walls.

21. The method of converting an uninsulated freight cargo container of claim 20 wherein the step of affixing the first insulated blanket to the adhesive support means comprises the step of removing the paper backing from a second adhesive coating on the strips and pressing the first insulated blanket, foil side directed outwardly, against said second adhesive coating.

22. The method of converting an uninsulated freight cargo container of claim 18 wherein the first and second insulated blankets are constructed of two layers of closed-cell polyethylene laminated on one side with a reflective foil.

23. The method of converting an uninsulated freight cargo container of claim 18 wherein the step of sealing comprises placing conventional packaging tape across the junction of the first insulated blanket with the second insulated blanket.

24. The method of converting an uninsulated freight cargo container of claim 18 wherein the first insulated blanket comprises discrete individual panels corresponding to individual walls of the uninsulated container.

25. The method of converting an uninsulated freight cargo container of claim 24 wherein the step of affixing the first insulated blanket comprises placing the individual panels over corresponding interior walls of the uninsulated container.

26. The freight container insulation system of claim 1 wherein the first insulated blanket and the insulated sheet are discrete components.

* * * * *